US007357698B2

(12) United States Patent
Choi

(10) Patent No.: US 7,357,698 B2
(45) Date of Patent: Apr. 15, 2008

(54) POLISHING PAD AND CHEMICAL MECHANICAL POLISHING APPARATUS USING THE SAME

(75) Inventor: Yong Soo Choi, Gyunggi-do (KR)

(73) Assignee: Hynix Semiconductor Inc., Icheon-si (KR)

( * ) Notice: Subject to any disclaimer, the term of this patent is extended or adjusted under 35 U.S.C. 154(b) by 0 days.

(21) Appl. No.: 11/289,942

(22) Filed: Nov. 29, 2005

(65) Prior Publication Data

US 2006/0270325 A1 Nov. 30, 2006

(30) Foreign Application Priority Data

May 24, 2005 (KR) ..... 10-2005-0043716

(51) Int. Cl.
*B24B 5/00* (2006.01)
*B24B 29/00* (2006.01)

(52) U.S. Cl. ..... 451/285; 451/527; 451/536; 451/550; 451/41

(58) Field of Classification Search ..... 451/285, 451/41, 527, 536, 550
See application file for complete search history.

(56) References Cited

U.S. PATENT DOCUMENTS 6,120,366 A * 9/2000 Lin et al. ..... 451/550
6,645,061 B1 * 11/2003 Bennett et al. ..... 451/527
6,699,115 B2 * 3/2004 Osterheld et al. ..... 451/527
6,974,372 B1 * 12/2005 Muldowney ..... 451/527
2002/0083577 A1 * 7/2002 Suzuki ..... 29/603.16
2004/0014413 A1 * 1/2004 Kawahashi et al. ..... 451/527
2004/0198056 A1 * 10/2004 Suzuki ..... 438/692
2005/0106878 A1 5/2005 Muldowney
2005/0218548 A1 10/2005 Preston et al.
2005/0260929 A1 * 11/2005 Shiho et al. ..... 451/41
2006/0019587 A1 * 1/2006 Deopura et al. ..... 451/526

FOREIGN PATENT DOCUMENTS

JP 2001-071256 3/2001
KR 10-2004-0070767 A 8/2004
TW 479000 B 3/2002
TW 1227521 B 2/2005

* cited by examiner

*Primary Examiner*—Joseph J. Hail, III
*Assistant Examiner*—Robert Scruggs
(74) *Attorney, Agent, or Firm*—Townsend and Townsend and Crew LLP

(57) ABSTRACT

A polishing pad for chemically mechanically polishing a semiconductor wafer comprises a first groove pattern circularly formed on the surface of the polishing pad, and a second groove pattern formed on the surface of the polishing pad while spirally extending from the circular center of the polishing pad to the outside so as to overlap the first groove pattern. The polishing pad further comprises a third groove pattern formed on the surface of the polishing pad while radially extending from the circular center of the polishing pad to the outside so as to overlap the first and second groove patterns. A chemical mechanical polishing apparatus comprises the polishing pad. The polishing pad of the chemical mechanical polishing apparatus has enhanced groove patterns formed on the polishing pad to provide uniform distribution of the slurry, thereby enhancing polishing speed and polishing uniformity.

14 Claims, 7 Drawing Sheets

POLISHING PAD AND CHEMICAL MECHANICAL POLISHING APPARATUS USING THE SAME

BACKGROUND OF THE INVENTION

The present invention relates to a polishing pad, and a chemical mechanical polishing apparatus using the same for manufacturing semiconductor devices.

A chemical mechanical polishing process is a process of flattening a semiconductor wafer among processes for manufacturing semiconductor devices, during which a chemical reaction of a polishing liquid is supplied in slurry form and mechanical polishing with a polishing pad are carried out on the wafer at the same time. In comparison to a reflow process or an etch-back process used for planarization of the wafer in conventional methods, the chemical mechanical polishing process can lead to global planarization, and can be performed at lower temperatures.

In particular, although the chemical mechanical polishing process may first involve a flattening process, it may also be applied to other processes, such as an etching process on a conductive film for formation of a bit-line contact pad and a storage node contact pad in a self-alignment contact (SAC) process. An apparatus for the chemical mechanical polishing process includes a platen having a polishing pad provided on an upper surface thereof, a slurry supplying unit to supply slurry to the polishing pad when polishing a wafer, a polishing head to compress the wafer to the platen in order to hold the wafer with respect to the polishing pad, and a polishing pad conditioner to reproduce the surface of the polishing pad. With the chemical mechanical polishing apparatus constructed as described above, the wafer is positioned on the platen while being compressed and held by the polishing head, to which the slurry is supplied from the slurry supplying unit, and then the polishing head is rotated to rotate the wafer and the platen at the same time, thereby polishing the wafer.

Meanwhile, during the chemical mechanical polishing process, the wafer can be flattened by adjusting the removal speed of a particular portion thereof. As a result, a groove pattern with a predetermined width, depth, and shape is formed on the polishing pad attached to the platen in order to allow easy flow of the slurry. The groove pattern acts as a major factor determining flow and distribution of the slurry continuously supplied during a polishing operation, and a polishing degree of the wafer.

FIG. 1*a* is a view illustrating a polishing pad of a conventional chemical mechanical polishing apparatus. FIG. 1*b* is an enlarged cross-sectional view taken along line X-X' of FIG. 1*a*.

Referring to FIGS. 1*a* and 1*b*, a general polishing pad 100 has a circular groove pattern 110 formed over the entire upper surface of the polishing pad. In addition, in a cross-section of the polishing pad 100 taken along the line X-X', each groove of the groove pattern 100 is formed in a vertical shape, i.e., at an angle of 0 degrees with respect to the central axis of the polishing pad.

FIG. 2 is a view illustrating a conventional chemical mechanical polishing process performed in the circular groove pattern.

Referring to FIG. 2, a groove pattern 210 formed on a polishing pad 200 functions to smoothly supply a polishing agent and a compound required for the chemical mechanical polishing process, and to efficiently remove the slurry and by-products of the process. Meanwhile, with the circular groove pattern 210, distribution of fresh slurry supplied over the polishing pad 200, and distribution of the by-products are different in respective regions of the polishing pad according to the position of a nozzle and a rotational direction. In addition, distribution 220 of the slurry is provided in the same direction as the rotational direction 230 of the polishing pad, so that the distribution of the fresh slurry and the by-products are different in respective regions of the polishing pad. As a result, the circular groove pattern lowers uniformity and the speed of polishing.

Although a spiral groove pattern can be formed on the polishing pad, distribution of slurry and by-products are also different in respective regions of the polishing pad, thereby lowering the uniformity and the speed of polishing.

SUMMARY OF THE INVENTION

Embodiments in accordance with the present invention provide a polishing pad for a chemical mechanical polishing apparatus, which has an enhanced groove pattern formed on the polishing pad to enhance polishing uniformity and properties of a chemical mechanical polishing process.

In accordance with one aspect of the present invention, the above and other features can be accomplished by the provision of a polishing pad for chemically mechanically polishing a semiconductor wafer, comprising: a first groove pattern circularly formed on a surface of the polishing pad; and a second groove pattern formed on the surface of the polishing pad while spirally extending from the circular center of the polishing pad to the outside so as to overlap the first groove pattern.

The polishing pad may further comprise a third groove pattern formed on the surface of the polishing pad while radially extending from the circular center of the polishing pad to the outside so as to overlap the first and second groove patterns.

In one aspect of the present invention, the first and third groove patterns have a positive angle with respect to the central axis of the polishing pad.

In another aspect of the present invention, the positive angle is about 15 to 25 degrees.

In still another aspect of the present invention, the first groove pattern has a depth of about 0.014 to 0.016 inches, a width of about 0.009 to 0.011 inches, and a pitch of about 0.05 to 0.07 inches.

The second and third groove patterns may have widths and depths of two or more times those of the first groove pattern.

The second and third groove patterns may extend in a direction opposite to a rotational direction of the platen.

In accordance with another aspect of the present invention, a chemical mechanical polishing apparatus comprises: a rotatable platen; a polishing pad according to the present invention positioned on the platen; a polishing head to compress a wafer to the platen so as to hold the wafer with respect to the polishing pad; and a slurry supplying unit to supply slurry to the polishing pad.

DESCRIPTION OF THE SPECIFIC EMBODIMENTS

Figure 1A:
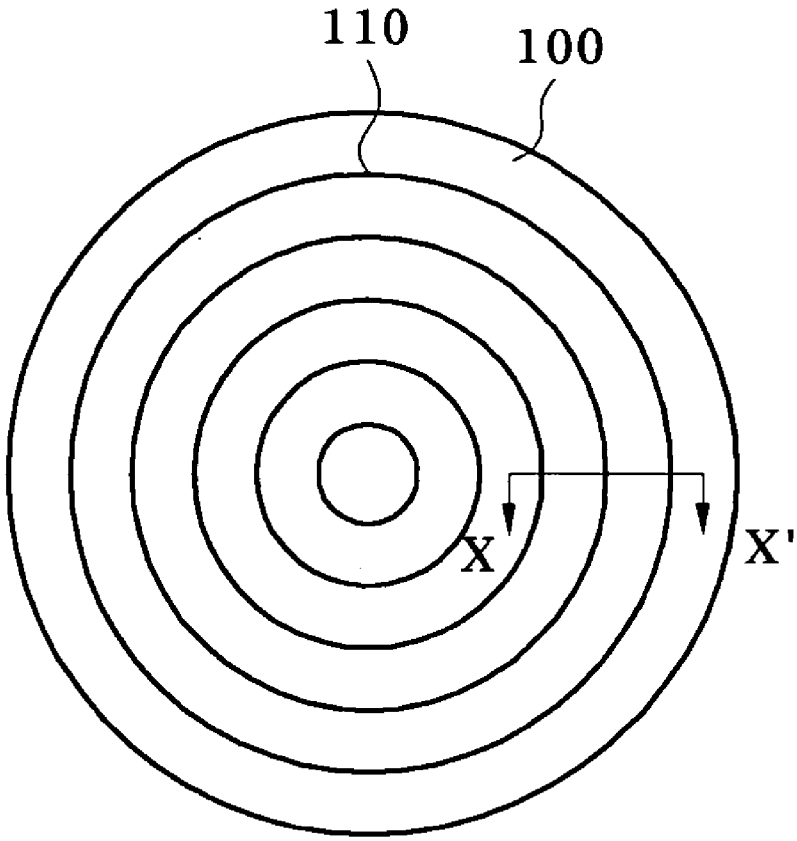
FIG. 1a (PRIOR ART)
FIG. 1*a* is a view illustrating a polishing pad of a conventional chemical mechanical polishing apparatus.

Embodiments of the present invention will be described in detail with reference to the accompanying drawings. It should be noted that the present invention may be embodied in various forms, and is not limited to the embodiments described herein. Thicknesses of layers and regions are exaggerated for the purpose of clear description thereof in the drawings. Like components are denoted by the same reference numerals throughout the description.

Figure 3:
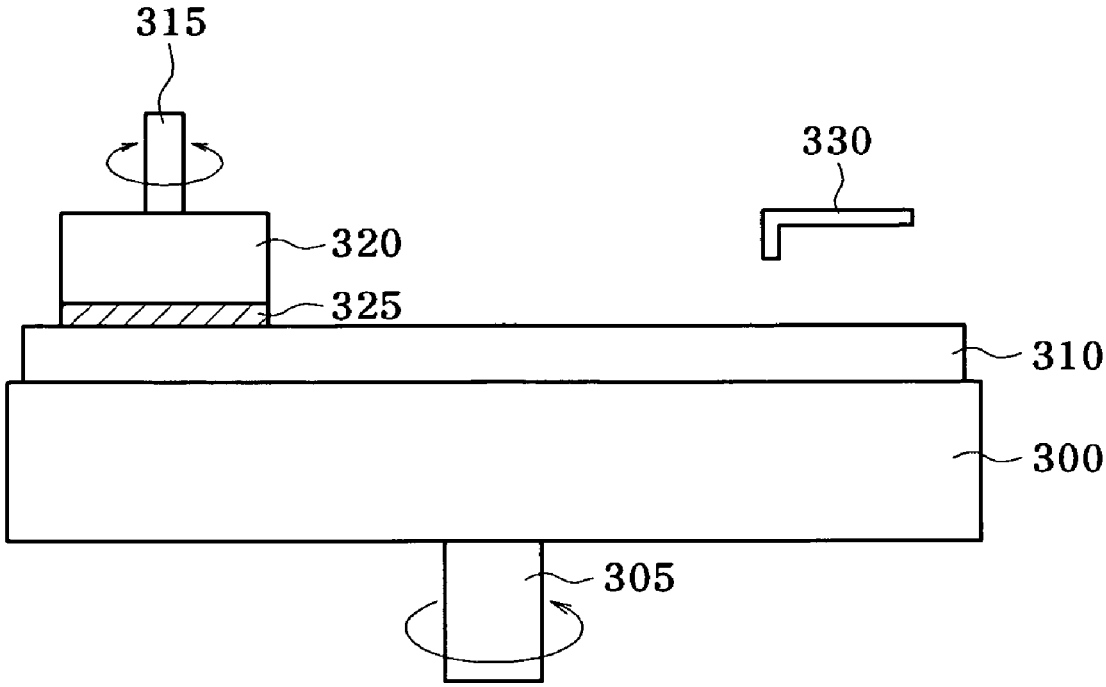
FIG. 3 is a view illustrating a chemical mechanical polishing apparatus in accordance with one embodiment of the present invention.

FIG. 3 is a view illustrating a chemical mechanical polishing apparatus in accordance with one embodiment of the present invention.

Referring to FIG. 3, the chemical mechanical polishing apparatus of the invention includes a platen 300 mounted on a rotational shaft 305 and having a polishing pad 310 attached to the platen 300, a polishing head 320 attached to another rotational shaft 315 at a position facing the platen 300 to hold a wafer 325 to be polished, and a slurry supplying unit 330 to supply slurry comprising a polishing agent to the surface of the polishing pad 310. The platen 300 is rotatable, and the polishing pad 310 positioned on the platen 300 is brought into contact with the wafer 325 to mechanically polish the surface of the wafer 325. The polishing head 320 is also rotatable, and compresses the wafer 325 to the platen 300 so as to hold the wafer 325 with respect to the polishing pad 310 on the platen 300 during the polishing process. The slurry supplying unit 330 is positioned near the center of the platen 300 to supply the slurry to the polishing pad 310 during the polishing process, at which the slurry polishes the surface of the wafer 325 via chemical reaction.

A flattening method using the chemical mechanical polishing apparatus of the invention will be described as follows.

At first, the platen 300 is rotated together with the polishing pad 310 attached thereon, and the polishing head 320 mounted on the rotational shaft 315 at the position facing the platen 300 to hold the wafer 325 to be polished is also rotated in the same direction as that of the platen 300. At this time, by applying a predetermined load to the polishing head 320, the wafer 325 attached to the polishing head 320 is brought into contact with the polishing pad 310 attached to the platen 300. At the same time, liquid slurry is supplied between the wafer 325 and the polishing pad 310 through the slurry supplying unit 330 while the wafer 325 and the polishing pad 310 are rotated. In this way, the wafer 325 is flattened by mechanical polishing of the polishing pad 310 to the wafer 325 and by chemical polishing of the slurry. At this time, polishing characteristics of the chemical mechanical polishing process are affected by uniform distribution of the slurry over the entire surface of the polishing pad 310. The distribution of the slurry is also affected by shapes in plane and in cross-section of a groove pattern formed on the polishing pad 310. Accordingly, the polishing pad according to the present invention has the following configuration.

Figure 4:
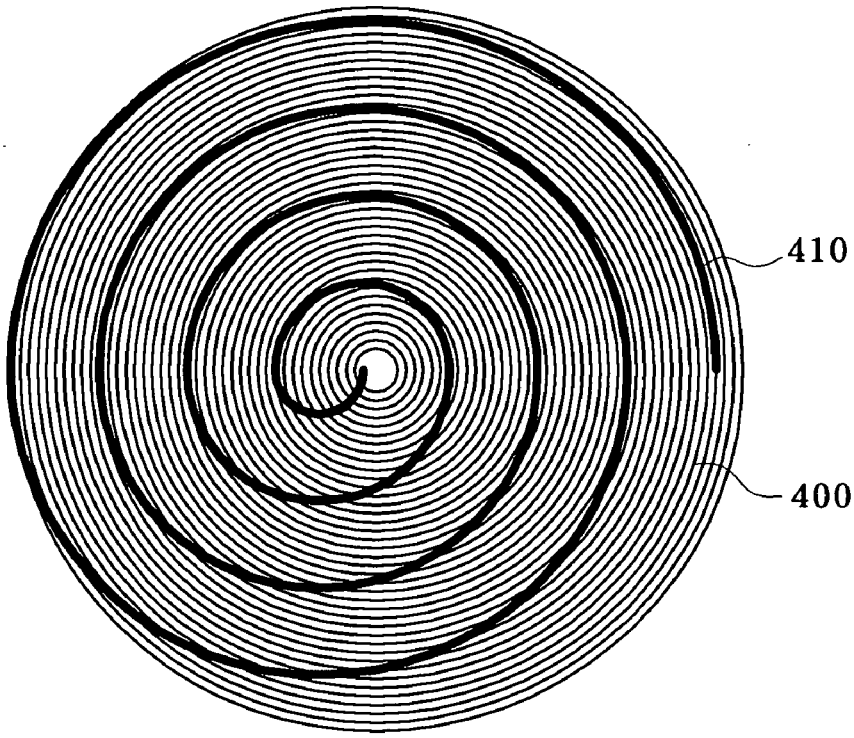
FIG. 4 is a view illustrating a polishing pad of the chemical mechanical polishing apparatus in accordance with one embodiment of the present invention.
Figure 5:
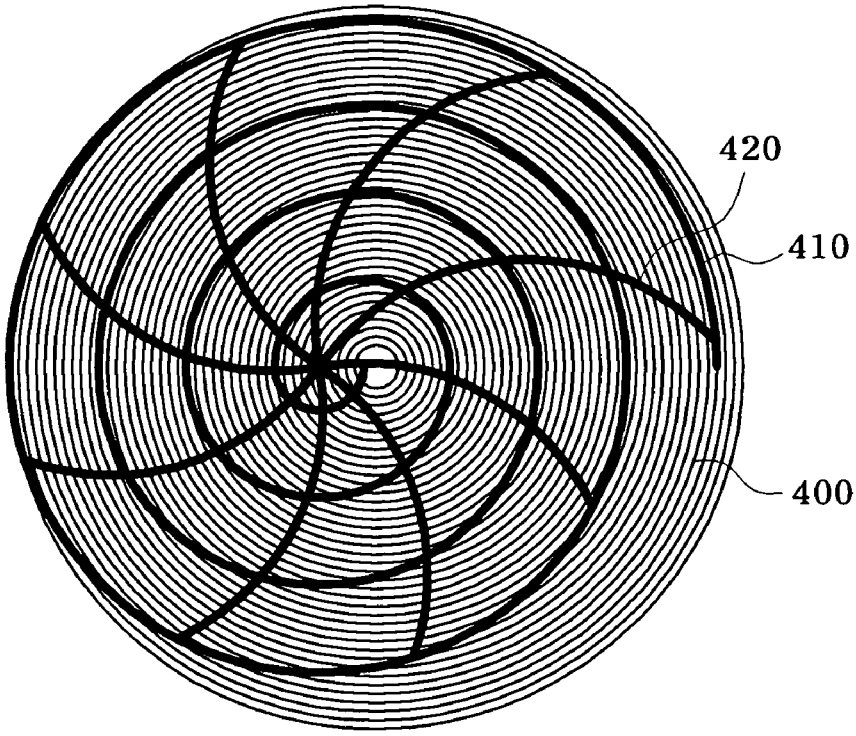
FIG. 5 is a view illustrating a polishing pad of the chemical mechanical polishing apparatus in accordance with another embodiment of the present invention.
Figure 6:
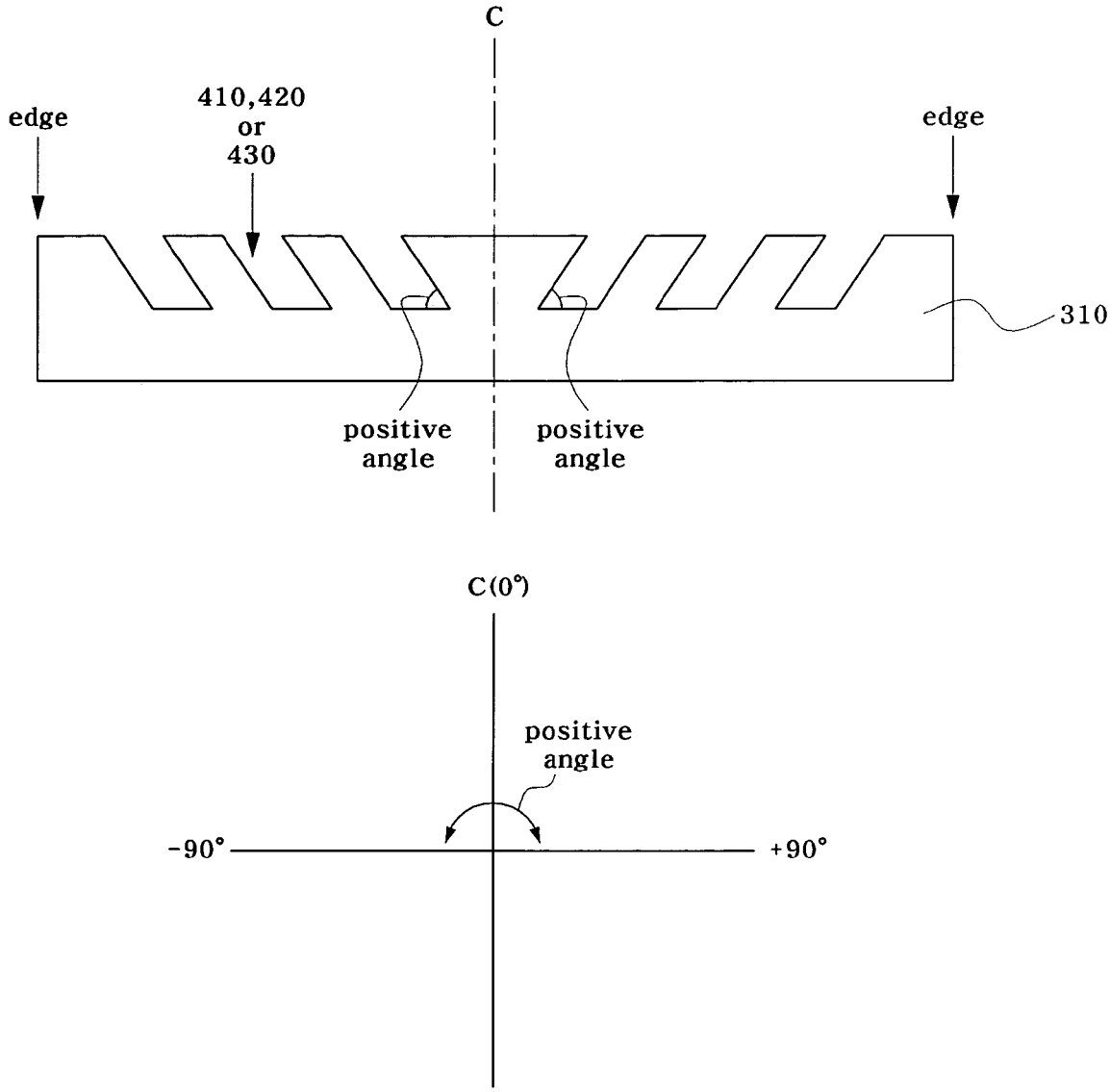
FIG. 6 is a view illustrating a groove pattern formed on the polishing pad of the chemical mechanical polishing apparatus in accordance with one embodiment of the present invention.

FIGS. 4 and 5 show polishing pads of the chemical mechanical polishing apparatus according to one embodiment of the present invention. FIG. 6 shows the groove pattern formed on the polishing pad of the chemical mechanical polishing apparatus according to one embodiment of the present invention.

Referring to FIG. 4, the polishing pad according to one embodiment of the invention comprises a first groove pattern 400 circularly formed on the surface of the polishing pad, and a second groove pattern 410 formed on the surface of the polishing pad while spirally extending from the circular center of the polishing pad to an outside so as to overlap the first groove pattern 400.

Referring to FIG. 5, the polishing pad according to another embodiment of the invention comprises a first groove pattern 400 circularly formed on the surface of the polishing pad, a second groove pattern 410 formed on the surface of the polishing pad while spirally extending from the circular center of the polishing pad to the outside so as to overlap the first groove pattern 400, and a third groove pattern 420 formed on the surface of the polishing pad while radially extending from the circular center of the polishing pad to the outside so as to overlap the first and second groove patterns 400 and 410.

Referring to FIG. 6, in the polishing pad of the chemical mechanical polishing apparatus according to one embodiment of the present invention, the first and third groove patterns 400 and 420 have a positive angle with respect to a central axis C of the polishing pad. In particular, according to the embodiments herein, the first and third groove patterns 400 and 420 are formed to have a positive angle of about 15 to 25 degrees. Herein, the term "positive angle" means an angle of 0 to 90 degrees at either side with respect to the central axis C of the polishing pad, and the term "negative angle" means an absolute value of an angle which is larger than 90 degrees with respect to the central axis C of the polishing pad. When the groove pattern of the polishing pad has a positive angle, removal efficiency of the slurry and by-products of the polishing process is increased by a centrifugal force.

The first groove pattern may have a depth D of about 0.014 to 0.016 inches, and a width W of about 0.009 to 0.011 inches. In addition, the first groove pattern may have a pitch P of about 0.05 to 0.07 inches. The second and third groove patterns have widths and depths two or more times those of the first groove pattern in order to enhance the removal efficiency of newly supplied slurry and by-products of the polishing process.

Figure 7:
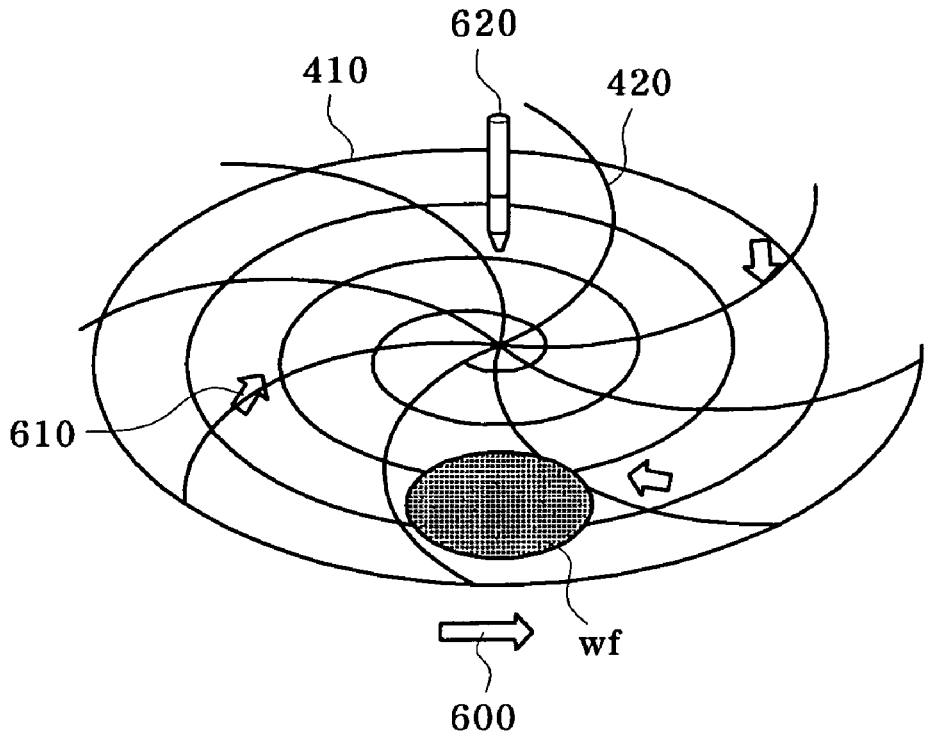
FIGS. 7 and 8 are views illustrating distribution of slurry on the polishing pad of the chemical mechanical polishing apparatus in accordance with one embodiment of the present invention.
Figure 8:
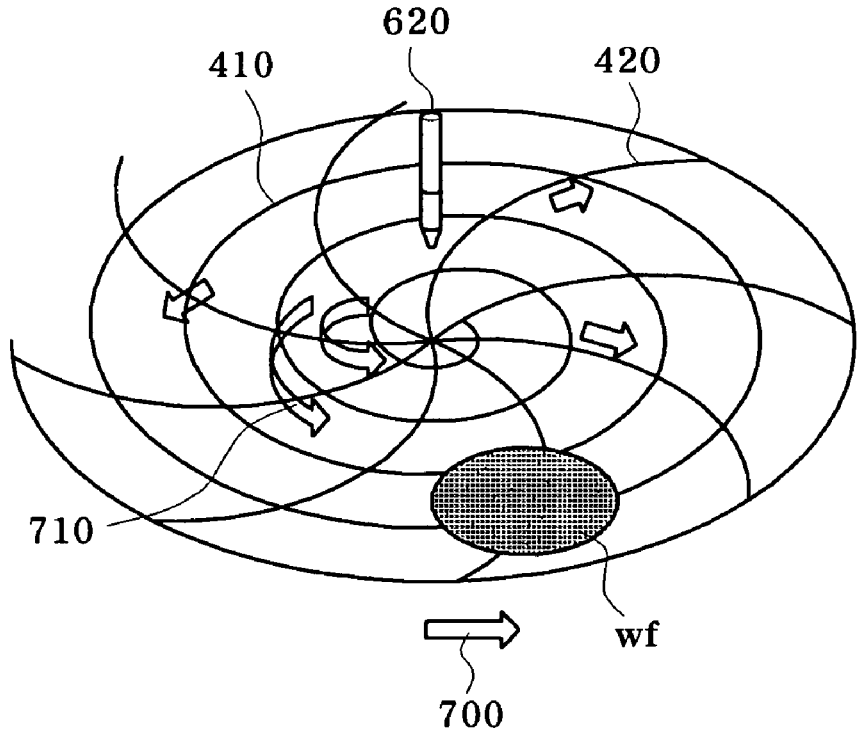

FIGS. 7 and 8 are views illustrating distribution of slurry on the polishing pad of the chemical mechanical polishing apparatus in accordance with one embodiment of the present invention.

When the slurry is supplied onto the rotating platen, a reaction force is applied to the slurry in a direction opposite to the rotational direction of the platen at the time of being dropped onto the polishing pad. In this case, as shown in FIG. 7, with the polishing pad on which the second groove pattern 410 of a spiral shape and the third groove pattern 420 of a radial shape overlap the first groove pattern 400 of a circular shape, if the rotational direction 610 of the second and third groove patterns 410 and 420 is the same as the rotational direction 600 of the platen, the slurry is concentrated on the center of the polishing pad, so that it is not uniformly distributed over the entire surface of the polishing pad.

Figure 9:
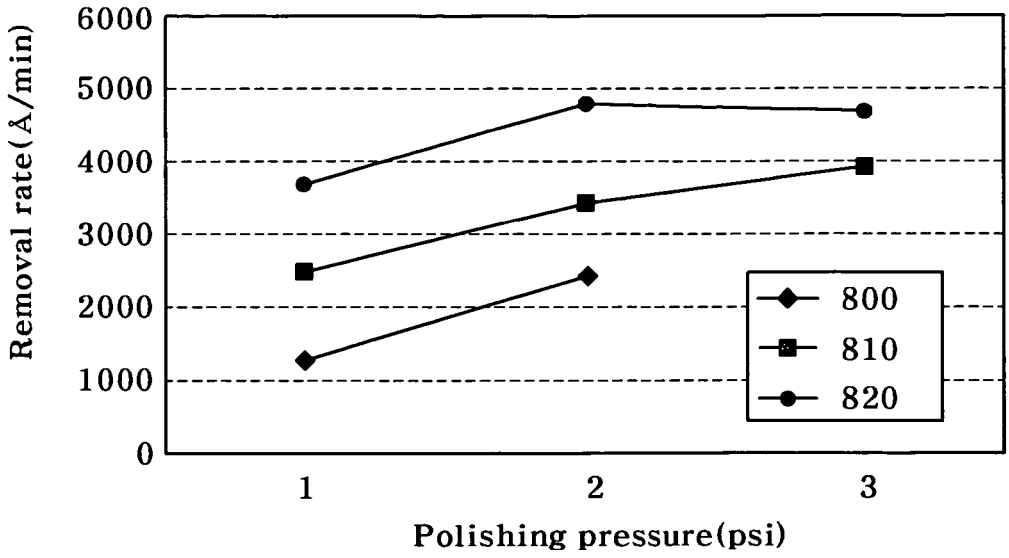
FIG. 9 is a graph depicting the relationship between the removal rate and polishing pressure of the conventional polishing pad and the polishing pad in accordance with one embodiment of the present invention.

On the contrary, if a rotational direction 710 of the second and third groove patterns 410 and 420 is opposite to the rotational direction 720 of the platen, the slurry is uniformly distributed over the entire surface of the polishing pad by the reaction force applied to the slurry, thereby further increasing polishing speed. In other words, when the rotational direction of the second groove pattern 410 of the spiral shape and the third groove pattern 420 of the radial shape is opposite to the rotational direction of the platen, the distribution of the slurry can becomes the maximum value, and the polishing pad can have the highest polishing speed. In FIGS. 8 and 9, the slurry supplying unit 620 is not described.

A result of an experiment using the polishing pad of the chemical mechanical polishing apparatus of the invention will be described hereinafter.

FIG. 9 is a graph depicting relationship between the removal rate and polishing pressure of the polishing pad and the polishing pad in accordance with one embodiment of the present invention.

As can be seen from FIG. 9, in comparison to a polishing pad 800 having only first groove pattern of a circular shape formed thereon, polishing pads 810 and 820, each having a second groove pattern of a spiral shape and a third groove pattern of a radial shape formed thereon to overlap the first groove pattern, have higher polishing speeds under an identical polishing pressure. In addition, as described above, it can also be appreciated that, when the rotational direction of the second groove pattern 410 (see FIG. 8) and the third groove pattern 420 (see FIG. 8) is opposite to the rotational direction 700 (see FIG. 8) of the platen, the polishing pad 820 has the highest polishing speed.

Figure 10:
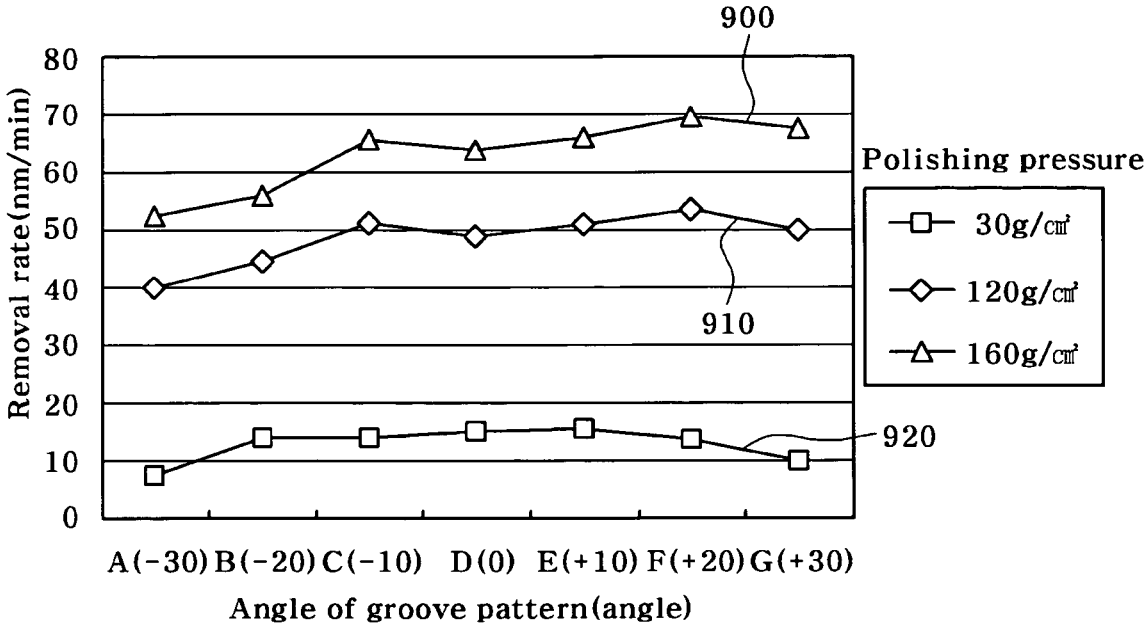
FIG. 10 is a graph depicting relationship between the removal rate and angle of the groove pattern in a cross-section of the polishing pad with respect to the central axis of the polishing pad of the chemical mechanical polishing apparatus in accordance with one embodiment of the present invention.

FIG. 10 is a graph depicting relationship between the removal rate and angle of the groove pattern in a cross-section of the polishing pad with respect to the central axis of the polishing pad of the chemical mechanical polishing apparatus in accordance with one embodiment of the present invention.

Figure 11:
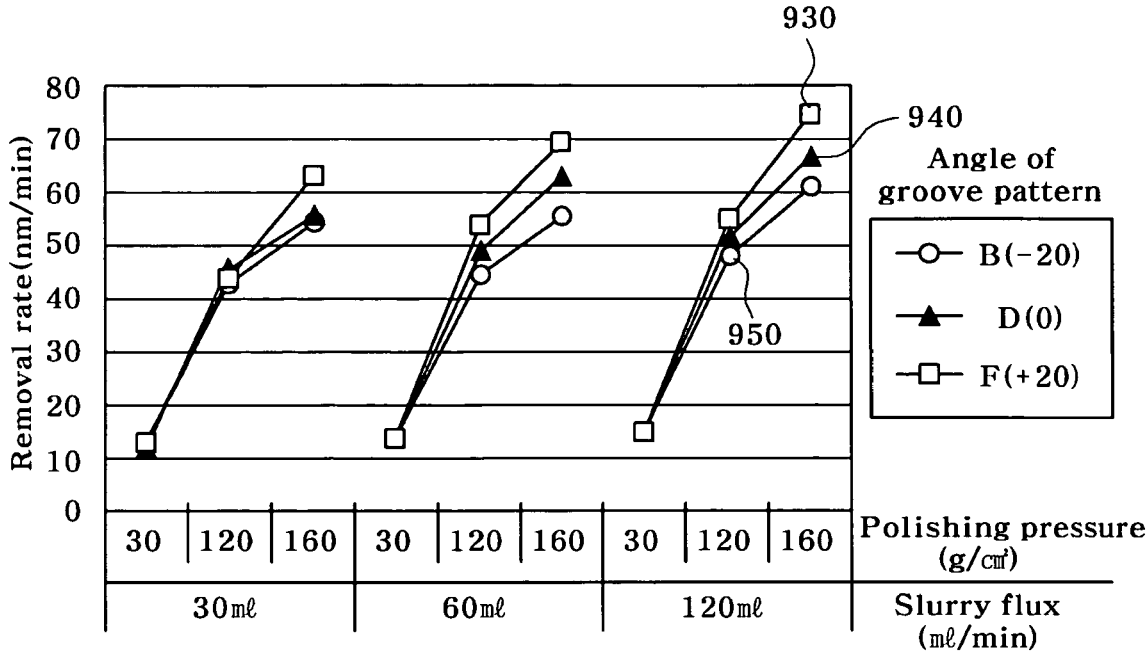
FIG. 11 is a graph depicting relationship between the removal rate and polishing pressure and a slurry flux according to the angle of the groove pattern in the polishing pad of the chemical mechanical polishing apparatus in accordance with one embodiment of the present invention.

FIG. 11 is a graph depicting the relationship between the removal rate and polishing pressure and a slurry flux according to an angle of the groove pattern in the polishing pad of the chemical mechanical polishing apparatus in accordance with one embodiment of the present invention.

Figure 1B:
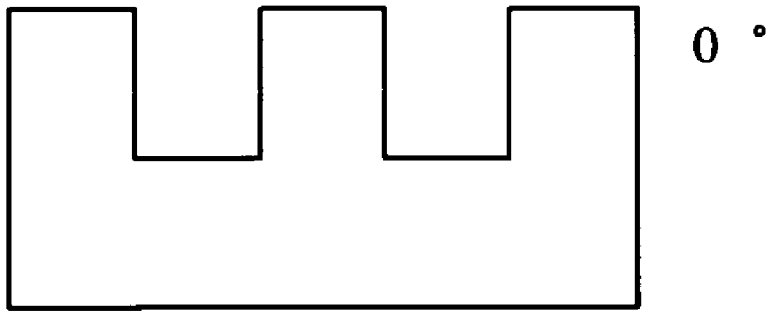
FIG. 1b (PRIOR ART)
FIG. 1*b* is an enlarged cross-sectional view taken along line X-X' of FIG. 1*a;*
Figure 2:
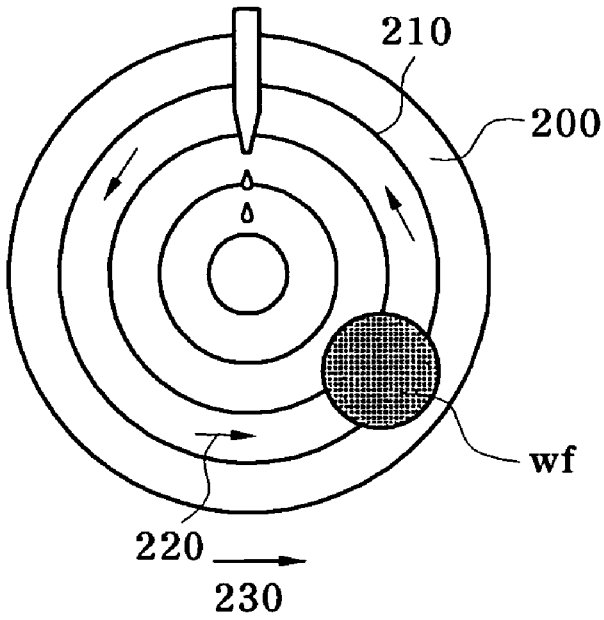
FIG. 2 (PRIOR ART)
FIG. 2 is a view illustrating a conventional chemical mechanical polishing process performed in the circular groove pattern.

As can be appreciated from reference numeral 900 in FIG. 10, when a cross-section of the groove pattern formed on the polishing pad has a positive angle with respect to the central axis of the polishing pad, the removal rate of the polishing pad is increased as the polishing pressure is increased. At this time, according to this embodiment, the groove pattern formed on the polishing pad may have a positive angle of about 15 to 25 degrees. Reference numerals 910 and 920 in FIG. 10 indicate removal rates when polishing pressures are 30 g/cm$^2$ and 120 g/cm$^2$, respectively. In addition, as can be appreciated from reference numeral 930 in FIG. 11, higher polishing pressure further increases the removal rate according to the angle of the groove pattern, and as more slurry is supplied to the polishing pad, the removal rate is further enhanced. Reference numerals 940 and 950 in FIG. 11 indicate removal rates according to the angle of the groove pattern formed on the polishing pad. Moreover, instead of the vertical groove pattern in the prior art (see FIG. 1*b*), the groove pattern of the positive angle (see FIG. 5) is formed on the polishing pad to allow the slurry supplied to the polishing pad and the by-product provided during the polishing process to be rapidly removed, so that fresh slurry can be smoothly supplied during the polishing process.

As apparent from the above description, according to the invention, the polishing pad of the chemical mechanical polishing apparatus has enhanced groove patterns formed on the polishing pad to provide uniform distribution of the slurry, thereby enhancing polishing speed and polishing uniformity.

It should be understood that the embodiments and the accompanying drawings have been described for illustrative purposes and the present invention is limited by the following claims. Further, those skilled in the art will appreciate that various modifications, additions and substitutions are allowed without departing from the scope and spirit of the invention according to the accompanying claims.

What is claimed is:

1. A polishing pad for chemically mechanically polishing a semiconductor wafer, the pad comprising:

a plurality of first groove patterns circularly formed on the surface of the polishing pad;

a second groove pattern spirally extending from a center of the polishing pad to a periphery of the polishing pad; and a third groove pattern radially extending from a central region of the polishing pad to the periphery of the polishing pad, wherein the first, the second and the third groove patterns crossing and intersecting with one another, and wherein the third groove pattern has a starting point from where the third groove pattern extend radially, the common starting point being off-center from the center of the polishing pad.

2. The polishing pad according to claim 1, wherein the first and second groove patterns have sidewalls tilted toward an edge of the polishing pad with a positive angle with respect to a central axis of the polishing pad.

3. The polishing pad according to claim 2, wherein the positive angle is about 15 to 25 degrees.

4. The polishing pad according to claim 1, wherein the first groove patterns have a depth of about 0.014 to 0.016 inches.

5. The polishing pad according to claim 1, wherein the first groove patterns have a width of about 0.009 to 0.011 inches.

6. The polishing pad according to claim 1, wherein the first groove patterns have-a pitch of about 0.05 to 0.07 inches.

7. The polishing pad according to claim 1, wherein the second groove pattern has a width and depth of two or more times the width and depth of the first groove patterns, respectively.

8. The polishing pad according to claim 1, wherein the third groove pattern has a width and depth of two or more times the width and depth of the first groove patterns, respectively.

9. A chemical mechanical polishing apparatus, comprising:

a rotatable platen;

a polishing pad having a plurality of first groove patterns circularly formed on the surface of the polishing pad, a second groove pattern spirally extending from a center of the polishing pad to a periphery of the polishing pad, and a third groove pattern radially extending from a central region of the polishing pad to the periphery of the polishing pad, wherein the first, second, and third groove patterns crossing and intersecting with one another;

a polishing head to receive the polishing pad and compress a substrate to the platen and polish the substrate; and a slurry supplying unit to supply slurry to the polishing pad, wherein the third groove pattern has a starting point from where the third groove pattern extend radially, the common starting point being off-center from the center of the polishing pad.

10. The polishing apparatus according to claim 9, wherein second and third groove patterns on the polishing pad extend in a direction opposite to the rotational direction of the platen.

11. The polishing apparatus of claim 9, wherein the second groove pattern extends from a center of the polishing pad to a periphery of the polishing pad.

12. The polishing apparatus of claim 11, wherein the second groove pattern extends spirally from the center to the periphery of the polishing pad.

13. The polishing pad according to claim 1, wherein a plurality of third groove patterns are extending from the starting point.

14. The polishing apparatus to claim 9, wherein a plurality of third groove patterns are extending from the starting point.

* * * * *